US009567809B2

(12) United States Patent
Savage

(10) Patent No.: US 9,567,809 B2
(45) Date of Patent: Feb. 14, 2017

(54) APPARATUS AND METHOD FOR LATERAL WELL DRILLING

(76) Inventor: James M. Savage, Ragley, LA (US)

( * ) Notice: Subject to any disclaimer, the term of this patent is extended or adjusted under 35 U.S.C. 154(b) by 886 days.

(21) Appl. No.: 13/226,489

(22) Filed: Sep. 6, 2011

(65) Prior Publication Data

US 2012/0067647 A1 Mar. 22, 2012

Related U.S. Application Data

(60) Provisional application No. 61/402,799, filed on Sep. 7, 2010, provisional application No. 61/402,803, filed on Sep. 7, 2010.

(51) Int. Cl.

| | |
|---|---|
| ***E21B 7/18*** | (2006.01) |
| ***E21B 17/20*** | (2006.01) |
| ***F16L 11/11*** | (2006.01) |
| ***E21B 10/60*** | (2006.01) |
| ***E21B 7/04*** | (2006.01) |
| ***E21B 7/24*** | (2006.01) |

(52) U.S. Cl.

CPC ..... *E21B 10/60* (2013.01); *E21B 7/046* (2013.01); *E21B 7/24* (2013.01)

(58) Field of Classification Search

CPC ..... E21B 7/04; E21B 7/061; E21B 49/10; E21B 17/20; E21B 7/065; E21B 7/18; F16L 11/11

USPC ..... 175/77; 464/19; 138/121

See application file for complete search history.

(56) References Cited

U.S. PATENT DOCUMENTS

| | | | | | |
|---|---|---|---|---|---|
| 1,367,042 | A * | 2/1921 | Granville | E21B 7/061 | 144/104 |
| 2,258,001 | A * | 10/1941 | Chamberlain | E21B 7/061 | 173/198 |
| 2,271,005 | A * | 1/1942 | Grebe | C09K 8/72 | 166/187 |
| 2,516,421 | A * | 7/1950 | Robertson | E21B 7/061 | 175/104 |
| 2,594,292 | A * | 4/1952 | Cornelius | E21B 49/06 | 175/107 |
| 4,007,797 | A * | 2/1977 | Jeter | E21B 4/00 | 173/149 |
| 5,553,681 | A * | 9/1996 | Huffstutler | E21B 10/18 | 175/339 |
| 6,189,629 | B1 * | 2/2001 | McLeod | E21B 7/061 | 175/321 |
| 6,283,230 | B1 * | 9/2001 | Peters | C09K 8/72 | 175/324 |
| 6,920,945 | B1 * | 7/2005 | Belew | E21B 7/061 | 166/298 |

* cited by examiner

*Primary Examiner* — Kenneth L Thompson

(57) ABSTRACT

A downhole tool assembly for cutting laterally into an earthen formation from a wellbore. The downhole tool assembly includes a cutting head assembly and a flexible tubular member, wherein the cutting head assembly includes a rotatable nozzle and a cutting head sized and configured to cut laterally into the earthen formation. The downhole tool assembly may be guided through a channel defined by a guide assembly and positioned such that the cutting head is proximate the portion of the earthen formation to be laterally cut. A rotational source may be operatively connected and in fluid communication with the conduit and flexible tubular member, whereby torque generated by the rotational source is translated by the flexible tubular member to the cutting head, causing the cutting head to rotate and cut the earthen formation.

23 Claims, 13 Drawing Sheets

APPARATUS AND METHOD FOR LATERAL WELL DRILLING

CROSS-REFERENCE TO RELATED APPLICATIONS

The present application claims priority to U.S. Provisional Application No. 61/402,799 and U.S. Provisional Application No. 61/402,803, both filed on Sep. 7, 2010.

FIELD

The present invention relates to an apparatus and method for cutting wellbore components and/or earthen formation surrounding the wellbore. More specifically, the invention relates to an apparatus and method for cutting earthen formation surrounding the wellbore, and optionally, casing and/or cement disposed in the wellbore, through the use of a rotatable cutting head assembly.

BACKGROUND

A multitude of wells have been drilled into earth strata for the extraction of oil, gas, and other material there from. In many cases, such wells are found to be initially unproductive, or may decrease in productivity over time, even though it is believed that the surrounding strata still contains extractable oil, gas, water or other material. Such wells are typically vertically extending holes including a casing usually of a mild steel pipe having an inner diameter of from just a few inches to over eight inches used for the transportation of the oil, gas, or other material upwardly to the earth's surface. In other instances, the wellbore may be uncased at the zone of interest, commonly referred to as an "openhole" completion.

In an attempt to obtain production from unproductive wells and increase production in under producing wells, methods and devices for forming a hole in a well casing, if present, and forming a lateral passage there from into the surrounding earth strata are known. For example, a hole in cased wells can be produced by punching a hole in the casing, abrasively cutting a hole in the casing, milling a hole in the casing wall or milling out a vertical section of casing. While more or less efficacious, such methods are generally familiar to those in the art. In openhole wells, the steps to form a hole in the casing are not required, but the methods for forming a lateral passage into the surrounding strata may be virtually identical to those used on cased well.

Under both the cased and uncased well scenarios, a type of whipstock is typically incorporated to direct the cutting head out of the wellbore and into the formation. The whipstock may be set on the end of production tubing. Because of the time and economic benefits, often the cutting tools are run on the end of coiled tubing. In at least one known conventional horizontal drilling method using coiled tubing, the cutting tool completes its transition to the horizontal direction over a radius of at least several feet and some methods require a radius of over 100 feet. The size of the radius stems primarily from the length and diameter of the cutting tools and the rigidity of the toolstring that must transition around the radius. Other known methods for creating horizontal drainage tunnels are able to transition a much tighter radius (e.g. within 4.5" casing) by not attempting to pass relatively long and/or large diameter tools (e.g. a mud motor) outside of the wellbore. Instead most such methods utilize a flexible jetting hose with a specialized and relatively small nozzle head (e.g., less than a few inches long). Such methods may be efficacious, but typically suffer from a common problem that that they do not and/or cannot provide adequate torque to satisfactorily power a mechanical cutting means capable of cutting harder formation. Accordingly, these methods may be limited only to very soft formations.

Furthermore, most known methods and apparatus have also generally been unable to provide technically or commercially satisfactory results because of an accumulation of cuttings in the wellbore. Many known apparatus utilizing a form of jetting nozzles have been found unable to produce a satisfactorily large hole in the strata and, even when directed at soft strata, have been found to hang-up when trying to advance the nozzle into the formation.

Other known methods for creating a lateral borehole entail transferring torque from a motor through multiple discrete but connected drive segments around the whipstock to the cutting head. While such drive systems may be capable of cutting earthen formation they may suffer from one or more of the following shortcomings: they may be more costly than other solutions; they may allow for cuttings to become entrapped between the segments thereby disrupting the smooth operation of the system; and/or they suffer from being more time consuming and/or costly to service and repair.

In addition to the aforementioned, cuttings created from the lateral drilling process or materials in the wellbore can also be problematic. If the rat-hole of the wellbore (the portion beneath the work area) is not deep enough to accommodate these materials, the materials can fill the wellbore up to or above the elevation of the whipstock. This in turn, can effectively preclude the removal of cuttings from the lateral borehole being drilled as the cutting have nowhere to fall and hence cause a stop in forward cutting of the lateral borehole. Additionally, cuttings in the wellbore can fill-up so that repositioning of the whipstock—such as to a new zone of interest—movement of the whipstock cannot be done.

In view of the above, it would be desirable to have a cutting tool comprised of an essentially continuous flexible member capable of being run on a wireline unit, on coil tubing or on jointed tubing or rod, the tool capable of being run in a wellbore and of transitioning in an effective radius of less than about 36 inches to a substantially horizontal orientation, wherein the cutting tool is provided with sufficient torque to cut even hard formation, like dolomite. It would further be desirable to have a cutting system capable of rotating under the power of fluid and wherein the fluid may be emitted from the cutting tool to provide assistance in the removal of cuttings, to clean the cutting faces and/or to cool the cutting tool.

SUMMARY

An embodiment of the present invention is an apparatus for cutting laterally into an earthen formation from a wellbore including a flexible tubular member having at least one inner passageway, the flexible tubular member being sized and configurable such that an attached cutting head assembly, the at least one inner passageway, and a fluid pumping source may be in fluid communication. A first flexible tubular member end portion is sized and configured to be attachable to a rotation means and a second flexible tubular member end portion operatively coupled to the cutting head assembly such that torque applied to the first flexible tubular member end portion by the rotational source may be translated to the cutting head assembly.

The cutting head assembly can have at least one cutting surface sized and configured to mechanically cut into the earthen formation. The cutting head assembly can have a nozzle having at least one orifice for the ejection of fluid, gas or combination thereof positioned on or near the cutting head assembly and capable of being in fluid communication with the fluid pumping source. The apparatus can include flutes or grooves on the flexible tubular member that can facilitate the removal of cuttings.

The cutting head assembly can further include a centering member sized and configured to retain the cutting head assembly substantially longitudinal about the axis of a substantially horizontal wellbore created by the apparatus when engaged in cutting laterally into the earthen formation and wherein the cuttings from the earthen formation may travel past the centralizing mechanism toward the wellbore.

The apparatus can include a secondary tubular member disposed within the at least one flexible tubular member inner passageway and capable of providing a substantially leak-proof fluid conduit between the pumping source and the cutting head assembly.

The flexible tubular member can be chosen from a spring circumscribed hose, interlocked hose, corrugated tubing, braided or multi-braid hose, cables helically wound about a hose or inner passageway, and combinations thereof. The flexible material can be selected from the group of an elastomeric material, hose, braided-hose, flexible tubing, KEVLAR®, tubing, convoluted tubing, interlocking hose, semi-rigid tubing, or combinations thereof.

The apparatus can be capable of emitting fluid from the at least one orifice on the nozzle providing at least one of the following benefits: keeping the cutting head clean, keeping the cutting head cool, emitting fluid to better dispose the formation to being cut, emitting chemicals for treating the formation, or emitting fluid to provide a medium for carrying formation cuttings back toward the wellbore.

The apparatus can have a flexible tubular member that is primarily comprised of one continuous flexible tubular shaft, coupled to a cutting head on one end and a rotational means on the other. The flexible tubular member can be deployed within a wellbore by means selected from the group consisting of jointed tubing, wireline, slickline unit, coiled tubing, and combinations thereof. The apparatus can include a rotational source selected from a fluid-driven motor, an electrical motor, or combinations thereof.

The apparatus can further include a whipstock to guide the cutting head assembly and flexible tubular member toward the earthen formation. The whipstock can include a passageway through which formation cuttings can pass from the cutting head assembly to a location below the whipstock. The apparatus can include a sealing apparatus used in conjunction with a slickline unit allowing fluid communication with surface pumping equipment, said sealing apparatus providing a sealing mechanism between a fluid motor and a tubular extending to the surface thru which fluid can be pumped, said sealing mechanism diverting flow from the surface pumping equipment through said tubular and into the fluid motor causing rotation of the motor and attached flexible tubular member and ultimately cutting head assembly, said motor connected to a wireline whereby the flexible tubular member may be lowered so as to create a lateral borehole in the earthen formation.

An embodiment of the present invention is a method for cutting laterally into an earthen formation from a wellbore utilizing the apparatus described herein.

An embodiment of the present invention is a method for cutting laterally into an earthen formation from a wellbore by guiding a downhole tool assembly comprising a flexible tubular member, with at least one inner passageway, through a channel defined by a guide assembly and positioning the downhole tool assembly within a wellbore so that the downhole tool assembly contacts a portion of the earthen formation to be laterally cut. The downhole tool assembly is coupled to a conduit, such that the conduit and downhole tool assembly are in fluid communication. The method includes pumping one or more fluids through the conduit and into the downhole tool assembly, rotating a cutting head of the downhole assembly and cutting a borehole into the earthen formation with the cutting head in a direction lateral to the wellbore.

In an embodiment the downhole tool assembly is operatively connected to a rotational source and the rotational source is coupled to a conduit, such that the conduit, rotational source, and downhole tool assembly are in fluid communication, and includes activating the rotational source, wherein a torque is applied to the flexible tubular member and translating the torque to a cutting head of the downhole tool assembly, wherein the torque causes the cutting head to rotate. The rotational source can be activated by the fluid flow through the conduit into the rotational source.

The flexible tubular member can define a tubular member inner passageway and the downhole tool assembly can further include a nozzle defining one or more openings in fluid communication with at least a portion of a secondary tubular member disposed within the tubular member fluid passageway. The method can further include pumping one or more fluids through the secondary tubular member and emitting the pumped fluid from the nozzle openings, whereby the fluid may contact the cutting head.

The nozzle openings can be one or more orifices selected from a nozzle orifice at the center of the cutting head, a nozzle orifice(s) that are situated about the radius of the axis of rotation of the nozzle head, a rotating nozzle, a pulsing nozzle, a nozzle that creates a swirling pattern in its discharge flow, a nozzle designed to produce cavitation, and combinations thereof The method can include forming a lateral borehole through a pre-existing hole created thru the casing, said hole created by one or more of the following methods: milling out the section of casing, abrasively cutting the casing, punching through the casing, cutting a hole in the casing, or using chemical to erode the wellbore casing.

The method can include forming a hole through a wellbore casing and further lowering said tools under rotation so as to cut through any adjacent cement and into the earthen formation.

The method can include pumping fluid to a location beneath the downhole tool assembly and at a sufficient velocity so as either suspend formation cuttings within the wellbore or to lift the cuttings to the surface; said procedure being done initially, periodically or continuously during the creation of the lateral borehole.

The method can include a means to vibrate at least a portion of the downhole assembly so as to mitigate the cutting head assembly and/or flexible tubular member from becoming stuck in the borehole.

The method can be used when the wellbore is an open hole wellbore and a borehole is formed into the earthen formation in a direction lateral to the open hole wellbore.

Figure 1:
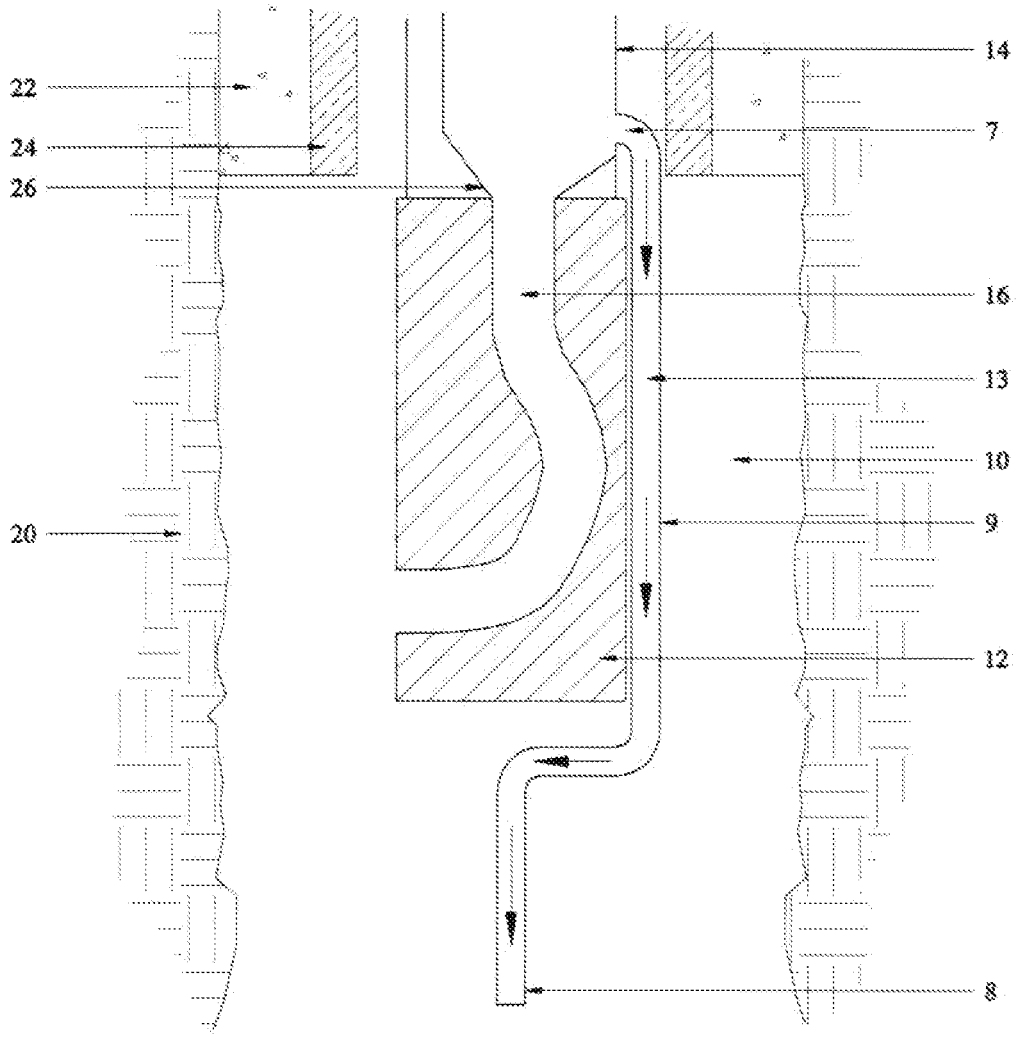
FIG. 1 illustrates a cross-sectional view of an openhole completed wellbore containing a whipstock prior to the use of the whipstock in conjunction with an embodiment of the present invention.

In an aspect of the current invention, an apparatus for cutting laterally into an earthen formation from a wellbore is provided. As used herein, the term "lateral" or "laterally" refers to a borehole deviating from the wellbore and/or a direction deviating from the orientation of the longitudinal axis of the wellbore. The orientation of the longitudinal axis of the wellbore in at least one embodiment is vertical, wherein such a wellbore will be referred to as a vertical wellbore or substantially vertical wellbore. However, it should be understood that the orientation of the longitudinal axis of the wellbore may vary as the depth of the well increases, and/or specific formations are targeted. As used herein, the term "strata" refers to the subterranean formation also referred to as "earthen formation." The term "earthen formation of interest" refers to the portion of earthen formation chosen by the operator for lateral drilling. Such earthen formation is typically chosen due to the properties of the formation relating to hydrocarbons.

The present invention relates to an apparatus, system, and method for cutting laterally into an earthen formation. Optionally, the apparatus may be used for cutting laterally into cement disposed within the wellbore. Optionally, the apparatus may be used for cutting laterally into the casing and cement disposed in the wellbore. Using the apparatus to cut laterally through the casing, cement, and earthen formation is advantageous in that the number of trips of downhole can be reduced significantly. The apparatus may be used in cased wellbores or openhole wellbores. Optionally, the apparatus may be used in wellbores wherein the one or more hole may have already been created through the casing and/or cement.

Generally, the apparatus will be run to a depth in the wellbore suitable for the retrieval of hydrocarbons and/or other desired materials. The location of the lateral boreholes will be operator specific and may vary based on the needs and goals of the operator. The location of the lateral boreholes may also be determined by the location of the wellbore and the environmental properties of the surrounding strata.

In at least one embodiment, the apparatus is a downhole tool assembly including a cutting head assembly and a flexible tubular member attached to a means of rotation. When in use in a wellbore, the downhole tool assembly can be connected to a spool assembly including a conduit that can be used to lower the downhole tool assembly inside the wellbore. For example, the downhole tool assembly may be connected to a fluid motor and coil tubing that can be lowered into a wellbore and operated so as to cause rotation of the apparatus. In another embodiment, the downhole tool assembly is coupled to jointed tubing or pipe and a pumping source, whereby the downhole tool assembly is in fluid communication with pumping equipment by virtue of the jointed tubing string. In another embodiment, the downhole tool assembly is operatively connected to pumping equipment and a slickline or e-line unit, which together allow for placement, operation and/or retrieval of the downhole tool assembly. In an embodiment, the downhole tool assembly is operatively connected to pumping equipment and jointed rod which together can be used to control the operation of the downhole tool assembly.

One end portion, or first end portion, of a conduit or tubing run into the wellbore can be coupled to a fluid pumping source. Optionally, the second end portion of the conduit is coupled to the first end portion of the flexible tubular member such that the fluid pumping source is in fluid communication with the flexible tubular member. The fluid pumping source can be any conventional fluid pump capable of providing fluid pressures to the downhole tool assembly such that the downhole tool assembly is able to emit fluid from or near the cutting head. Optionally, the fluid may be emitted at a pressure from about 100 to 5000 psi. Optionally, the fluid may be pumped at a pressure from about 5,000 to about 15,000 psi. The flow rate of the fluid may range from about 4 to about 12 gallons per minute (gpm). In another embodiment, the operating flow ranges from about 10 to about 20 gpm. In a further embodiment, the operating flow ranges from about 15 to about 35 gpm. Non-limiting examples of the fluid pumped from the fluid pumping source include nitrogen, air, foam, diesel, hydrochloric acid, water, formation brine, biocides, wettability agents, surfactants, and the like.

In an embodiment, the second end portion of the conduit is coupled to a rotational source in an embodiment of the present invention. In at least one embodiment, the rotational source can be a motor sized and configured to be run into the wellbore and capable of operating at the depth and conditions desired by the well operator. A non-limiting example of such a motor is a mud motor, such as the 175R5640 manufactured by Roper Pumps. The motor can be operatively coupled to a first end portion of the flexible tubular member, discussed further below. The motor can be coupled to the first end portion of the flexible tubular member such that a torque generated by the motor is applied to the flexible tubular member, thereby causing the flexible tubular member to rotate consistent with the torque applied by the motor. The motor may be further configured such that the fluid pumping source may be in fluid communication with the first end portion of the flexible tubular member, discussed more fully below. In another embodiment, the rotation source of the downhole toolstring may be a surfaced-based rotational source, such as a power swivel, which is used to rotate the downhole toolstring by virtue of rod or tubing connected to the downhole toolstring. In yet another embodiment, the rotational source connected to the downhole tool may be a DC motor, such as operated by an e-line unit.

Optionally, the downhole tools may include a vibration source. The vibration source may be sized and configured to impart vibrations to shake the cutting head assembly and/or flexible tubular member to facilitate the removal of cuttings and allows the cutting head assembly to more effectively penetrate into and be retrieved from the earthen formation. Optionally, the vibration source may be attached to the flexible tubular member or cutting head assembly. Optionally, the vibration source may be derived directly from the rotational source. The rotational source may further include a transmission, wherein the torque or revolutions per minute (rpm) of the rotational source may be adjustable.

As discussed above, the downhole tool assembly includes a flexible tubular member in at least one embodiment of the present invention. The flexible tubular member includes a first end portion discussed above and a second end portion wherein the second end portion can be coupled to the cutting head assembly. The flexible tubular member defines at least one hollow tubular cavity or inner passageway. In an embodiment used with a sealing mechanism, described in more detail below, porting between the outside and inside of the flexible tubular member allows fluid to enter into the inner passageway where it may flow to the cutting head assembly. The first end portion of the flexible tubular member may be operatively connected to a motor, whereby torque applied to the flexible tubular member by the actuation of the motor may be translated to the cutting head assembly coupled to the second end portion of the flexible tubular member. The cutting head assembly may rotate from the translated torque thereby cutting the earthen formation.

Optionally, the flexible tubular member includes one or more centralizing members that can enable it to be centralized with respect to the wellbore and/or lateral borehole. Non-limiting examples of centralizing members include radially oriented pins, brushes or springs.

In at least one embodiment, the downhole tool assembly may include an upper cross-over member connected to the first end of the flexible tubular member. In at least one embodiment, the upper cross-over member has at least one passageway allowing for it to transmit fluid from a motor to the inside of the flexible tubular member. In at least one embodiment, the upper cross-over member has porting that allows fluid to be directed to from upset tubing to inside the flexible tubular member. In at least one embodiment, the upper cross-over member is coupled to a motor on the one side and to the flexible tubular member on the other side, so as to allow for the transmission of torque to the flexible tubular member. In at least one embodiment, the upper cross-over member can both transmit torque and allow for the transmission of fluid through a passageway.

The flexible tubular member comprises a semi-rigid tubular component capable of transitioning through the radius of a whipstock. By virtue of its relative rigidity, the flexible tubular member is capable of transmitting torque around the radius of a whipstock. Additionally, by virtue of its inner passageway, the flexible tubular member is capable of transferring fluid between its opposing ends—and more specifically from its first end portion to its second end portion connected, which is connected to the cutting head assembly. In at least one embodiment, the flexible tubular member is essentially composed of a single continuous member. In at least another embodiment, the flexible tubular member may be comprised of multiple sub-components forming a virtually continuous member. The sub-components may be discrete items like a spring that circumscribes a hose or it may be segments of an essentially tubular nature that are joined together to form a whole. Non-limiting examples of the flexible tubular member include: a spring circumscribed hose, interlocked hose, corrugated tubing, braided or multi-braid hose, or cables helically wound about a hose or inner passageway.

Optionally, an exterior surface of the flexible tubular member defines one or more flutes, grooves or rifling, which can facilitate cuttings from the borehole to flow past the flexible tubular member and up the wellbore.

In an embodiment, the cutting head assembly includes a cutting head, wherein the cutting head can be detachably attached to the cutting head assembly and further configured to be rotatable and to cut laterally through casing, cement, and/or earthen formation. Optionally, the cutting head assembly defines a cutting head sized and configured to cut laterally through casing, cement, and/or earthen formation. The cutting head can form one or more recesses that are in communication with the exterior of the cutting head assembly. The recess(es) may allow for some or all of the following: to allow for positioning of the one or more exit orifices and fluid flow out of the cutting head assembly, to allow for efficient cutting of the formation and/or to allow provide a passageway for cutting to be removed from the cutting head area. The cutting head includes one or more cutting surfaces or faces, and may be configured such that one or more orifices may be able to eject fluid, gas or a combination thereof near the cutting surface(s) or face(s). A cutting face may circumscribe a portion of a rotatable nozzle, or a plurality of cutting faces may collectively circumscribe a portion of a rotatable nozzle. The cutting head can be continuous or segmented (e.g. serrated). The cutting face(s) can be formed from a material of sufficient hardness for cutting the intended earthen formation and/or casing and cement. For example, at least a portion of the cutting face may be formed from carbide or diamond.

The cutting head can be defined by the cutting head assembly or fixedly attached or can be detachably attached to the cutting head assembly. A non-limiting example of a detachable attachment is conventional threading. In an embodiment, the cutting head is detachably attached to the cutting head assembly, wherein the cutting head assembly includes one or more bearings or the like to facilitate rotation of a rotatable nozzle. The bearing may be a mechanical bearing, such as a bronze bushing, needle bearing, or ball bearing. Optionally, the bearing may be a fluid bearing, wherein a fluid bearing may be created upon the pumping of a fluid into the flexible tubular member and cutting head assembly. Optionally, the fluid and/or mechanical bearings may be used in conjunction with seals.

The cutting head assembly defines one or more head assembly openings in an embodiment of the present invention. The head assembly openings can be sized and configured to permit fluid flow there through. The cutting head assembly can include a secondary tubular member wherein the secondary tubular member defines one or more secondary tubular member openings sized and configured to permit fluid flow there through into a space or chamber located inside the rotatable nozzle, discussed below. The cutting face may define one or more cutting face openings and the interior face surface may define one or more cutting face openings, wherein the cutting face opening is in fluid communication with the fluid pumping source. The head assembly openings and/or secondary tubular member openings can be stationary with respect to the cutting head or can move independently of the cutting head. Fluid flow through the head assembly openings and/or secondary tubular member openings can be used to keep the cutting head cool, facilitate the removal of cuttings from the borehole, and/or impart rotation of the cutting head and/or a rotatable nozzle.

Optionally, the cutting head assembly includes one or more centering members sized and configured to retain the cutting head assembly centrally located along the longitudinal axis of a borehole created by the apparatus when engaged in cutting laterally into the earthen formation. Non-limiting examples of suitable centering members include bow springs, brushes, pins, and fluids. The centering member also may function to allow cuttings and fluid or gases emitted from the cutting head assembly to readily pass the cutting head assembly and move toward the wellbore.

In an embodiment, the pressure of the fluid at the nozzle openings is greater than about 100 psi. In another embodiment, based on desired operator parameters and treatment protocol, the pump pressure may be from about 5,000 psi to about 12,000 psi. The fluid pumped through the nozzle openings may accomplish one or more of the following: keeping the cutting head cool for cutting face longevity, keeping the cutting faces clean for efficient formation drilling, providing a carrying medium for transporting of cutting toward the wellbore, ejecting chemicals to better dispose the formation to being cut, or to inject a chemical (e.g. biocides, inhibitors, wettability modifiers, etc.) to treat the formation adjacent to the lateral borehole.

As stated above, the cutting head assembly can be connected to the second end portion of the flexible tubular member, wherein a motor can be connected to the first end portion of the flexible tubular member, such that the flexible tubular member is rotatable when the motor is engaged. In an embodiment, the motor can be driven by the flow of fluid from the conduit, thereby causing the flexible tubular member to rotate, wherein at least a portion of the fluid used to drive the motor is transmitted inside the flexible tubular member to the cutting head assembly.

In an embodiment, the cutting head assembly may comprise a specialty nozzle head, such as a rotating nozzle, a pulsing nozzle, a nozzle that creates a swirling pattern in its discharge flow, a nozzle designed to produce cavitation. Such nozzles maybe necessary or desirable to more effectively clean the cutting head to facilitate the return of cuttings back to the wellbore and/or for marketing purposes. In more than one embodiment, the nozzle(s) are directed at the cutting faces.

In an embodiment, the fluid leaving the nozzle opening(s) on the cutting head can generate rotation of a rotatable nozzle, such as through an exit orifice asymmetrically oriented with respect to the axis of rotation of the nozzle. Optionally, a rotatable shaft contained in a mating body of the nozzle head assembly may be connected to the rotatable nozzle to provide stabilization and a consistent axis of rotation for that nozzle. Optionally, the rotatable nozzle and/or attached rotatable shaft may comprise a fluid bearing with the mating body. At least a portion of the rotatable nozzle can be disposed within a recess formed by the cutting head. In at least one embodiment, the rotatable nozzle is positioned toward the center of the recess formed by the cutting head.

Turning now to a system and method for cutting laterally into an earthen formation from a wellbore, a whipstock is employed in at least one embodiment of the present invention. As used herein, the term "whipstock" refers to any downhole device capable of positioning the cutting head assembly toward the earthen formation desired for lateral cutting. The whipstock defines a guide channel sized and configured to receive and guide the cutting head assembly and at least a portion of the flexible tubular member through the whipstock and proximate the earthen formation of interest. In at least one embodiment, the whipstock may guide the cutting head assembly into a substantially horizontal direction from a vertical wellbore such that the cutting head assembly is disposed approximately 90 degrees from the longitudinal axis of the wellbore. The whipstock may be disposed in the casing prior to the running of the downhole tool assembly. Optionally, the whipstock may be set with a coil tubing unit, on the end of production tubing or it may be set by a wireline unit. The whipstock may have one or more passageways running through it that allow cuttings from the lateral borehole to fall toward the bottom of the wellbore.

Optionally, the flexible tubular member may comprise a section that is adaptable to the whipstock and forms a seal with the whipstock. This seal may restrict the backflow of fluid and materials up the whipstock so as to seal out any cuttings washing back from the lateral borehole. This may be desirable in order to prevent cuttings from clogging the guide path of the whipstock, which could inhibit the free travel of the flexible tubular member.

Optionally, the guide assembly may have one or more passageways extending from the guide path to below the whipstock to allow cuttings to freely fall toward the bottom of the wellbore.

Optionally, the bottom hole assembly may define one or more circulation passageways traversing from above the whipstock to below the whipstock, allowing for cleanout of the wellbore. In an embodiment, the circulation pathway(s) may extend around the whipstock, connecting to the upset tubing on the one end and to a passageway through the center of a packer on the other end. In another embodiment, they extend through the bottom of the whipstock and also serve to as the passageway(s) used to allow cuttings to freely fall from the guide path toward the bottom of the wellbore. The passageway(s) may serve as a circulation path for fluid that is circulated through the wellbore for the removal of cuttings, sand, paraffin and other materials that may have accumulated in the wellbore below the whipstock. For example, it may be necessary to remove cuttings from below the whipstock in order to allow the bottom hole assembly to be repositioned to a lower zone of interest for the creation of another lateral. Additionally, cleaning out any cutting in the wellbore maybe necessary for the proper operation of the packer. In an embodiment, the circulation opening(s) extend around the whipstock to a location at the end of the bottom hole assembly located 5 feet below the whipstock. Pumping of fluid to circulate the wellbore through these opening(s) may be done initially, periodically or continuously. In an embodiment, maximum circulation velocity is attained by retracting the downhole toolstring into the primary wellbore (e.g. into the upset tubing). In this fashion, unobstructed flow through the circulation passageway(s) is best created, allowing for optimal wellbore cleanout. Cleaning out the wellbore and unloading the well may be accomplished by pumping fluid or gas at sufficiently high pressure and volumes through one or more of the circulation passageways.

Optionally, the system may be used with a form of containment system for the flexible tubular member. This system may be comprised of a series of collapsible cups, stackable centralizers or sheathing. The purpose for this system is to allow for the efficient transference of weight from the top of the flexible tubular member to the bottom of the flexible tubular member by preventing the flexible tubular member from forming a helical path or buckling when weight is applied to it from above.

The flexible tubular member connected to the cutting head assembly can be fed, or transitioned, through a whipstock, such that the cutting head of the cutting head assembly is positioned proximate the earthen formation of interest for lateral cutting. Optionally, the cutting head is positioned proximate the portion of the casing and/or cement proximate the earthen formation of interest for lateral cutting. In an embodiment, the motor coupled to the first end portion of the flexible tubular member is actuated, whereby torque is generated by the motor and applied to the flexible tubular flexible. The flexible tubular member is sized and configured such that torque applied to the first end portion of the flexible tubular flexible can be translated to the cutting head assembly coupled to the second end portion of the flexible tubular flexible. The cutting head of the cutting head assembly rotates from the torque applied to the cutting head assembly and, in turn, the cutting faces contact the earthen formation, thereby cutting into the formation. Optionally, the cutting faces contact the casing and/or cement in wellbore environments wherein openings have not been pre-drilled in the casing and/or cement proximate the earthen formation of interest.

Optionally, a nitrogen generator at the surface may be provided and used in conjunction with a closed loop system to clean out cuttings from the lateral borehole and/or wellbore. Optionally, pumping pressure and volumes may be sufficiently high so as to allow the nitrogen and cuttings to be lifted back up the wellbore; the nitrogen may then be circulated back to the generator, and the process may be repeated. Optionally, the nitrogen may be pumped through a downhole motor and to the cutting head. This closed loop nitrogen system is cost beneficial since a smaller system may be used and the need for a fluid pump including liquids may be eliminated.

In an embodiment, a wellbore including a whipstock set at the desired depth in the wellbore is equipped with a fluid pumping source and a coil tubing unit including a spool of coil tubing, wherein a first end portion of the coil tubing is coupled to the fluid pumping source, and the second end portion of the coil tubing is coupled to a rotational source. The rotational source can be a motor as discussed above. The motor in this embodiment is attached to a downhole tool assembly including a cutting head assembly and a flexible tubular flexible, wherein the fluid pumping source, coil tubing, flexible tubular flexible, and cutting head assembly are in fluid communication. Optionally, at least a portion of a secondary tubular member is disposed within the flexible tubular flexible and the secondary tubular member is in fluid communication with the fluid pumping source and the cutting head assembly. The coil tubing including the coupled motor and downhole tool assembly are lowered into the wellbore wherein at least a portion of the downhole tool assembly contacts the whipstock and is guided into the guide channel and positioned proximate the earthen formation of interest.

Optionally, the second end portion of the coil tubing is coupled to the downhole tool assembly such that the coil tubing is in fluid communication with the downhole tool assembly. The fluid pumping source can be coupled to the first end portion of the coil tubing in this embodiment. The coil tubing coupled to the downhole tool assembly is lowered into the wellbore wherein at least a portion of the downhole tool assembly contacts the whipstock and is guided into the guide channel and positioned proximate the earthen formation of interest.

Having described many of the apparatus of the present disclosure, let us further discuss the methods by which they system may be conveyed through the pre-positioned whipstock.

In an embodiment wherein a whipstock is disposed in a wellbore, a coiled tubing and pumping equipment can be connected to the upper end of the flexible tubular member such that fluid pumped through the coiled tubing can drive a fluid motor and the attached flexible tubular member and cutting head assembly. Now under rotation, the flexible tubular member and attached cutting head can be directed out of the wellbore by the pre-positioned whipstock in order to cut a lateral borehole in the surrounding earthen formation. Optionally, the flexible tubular member and attached cutting head may be used to through the casing and cement, if present, and proceed to cut into the surrounding earthen formation.

In an embodiment, wherein a whipstock is disposed in a wellbore and is coupled to a section of upset tubing, a slickline unit, such as familiar to those in the industry, can be used to position and control the travel of the downhole tool assembly. In this embodiment, a fluid driven motor is connected to the end of the slickline string on the one end and the flexible tubular member and attached cutting head on the other end. The system can include one or more elastomeric sealing mechanisms positioned on or above the motor; the elastomeric mechanisms forming a relatively complete seal with the upset tubing. The sealing mechanism diverts fluid flowing through the upset tubing into the fluid motor, thereby causing the motor and attached flexible tubing member to rotate. Now rotating, the toolstring can be lowered so as to allow the cutting head to cut into the formation In an embodiment wherein a whipstock is disposed in a wellbore, a wireline unit, such as familiar to those in the industry, can be used to position and control the travel of the downhole tool assembly. In this embodiment, an electrically driven motor is connected to the end of the wireline on the one end and to the flexible tubular member and attached cutting head assembly on the other. This system can include one or more elastomeric sealing mechanisms positioned on or above the motor; the elastomeric mechanisms forming a relatively complete seal with optional upset tubing. The sealing mechanism diverts fluid flowing through the upset tubing into the flexible tubular member and to the cutting head. Now rotating, the toolstring can be lowered so as to allow the cutting head to cut into the formation.

In an embodiment wherein a whipstock is disposed in the cased wellbore and a wireline unit, such as familiar to those in the industry, can be used to position and control the travel of the downhole tool assembly. In this embodiment, an electrically driven motor is connected to the end of the wireline on the one end and to the flexible tubular member and attached cutting head assembly on the other. This system can include one or more elastomeric sealing mechanisms positioned on or above the motor, the elastomeric mechanisms forming a relatively complete seal with optional upset tubing. The sealing mechanism diverts fluid flowing through the upset tubing into the flexible tubular member and to the cutting head. Now rotating, the toolstring can be lowered so as to allow the cutting head to cut into the formation.

In an embodiment a pumping equipment and jointed tubing, positioned by drilling or work-over equipment, can be connected to the upper end of the flexible tubular member such that fluid pumped through the jointed tubing can drive a fluid motor and the attached flexible tubular member and cutting head assembly. Now under rotation, the flexible tubular member and attached cutting head can be directed out of the wellbore by the pre-positioned whipstock in order to cut a lateral borehole in the surrounding earthen formation. Optionally, the flexible tubular member and attached cutting head may be used to through the casing and cement, if present, and proceed to cut into the surrounding earthen formation.

Turning now to the Figures, FIG. 1 illustrates an open hole completed wellbore (10) containing an orienting device (12), illustrated as a whipstock, coupled to a section of upset tubing (14). The whipstock (12) defines a guide channel (16) sized and configured to guide at least a portion of the flexible tubular member (not shown) of this disclosure to a position proximate the earthen formation of interest (20). The wellbore (10) contains an uncased section where the whipstock is shown and a cased section above the whipstock that includes a layer of cement (22) disposed between the casing (24) and earthen formation (20). An incline (26) is situated above the orienting device (12) to guide tools (not shown) into the guide channel (16). A circulation passageway (13) extending around the orienting device (12) formed, in this case, by a tubular member (9) in fluid communication with the upset tubing (14) at an upper entrance opening (7) and with the wellbore (10) at a lower exit opening (8) situated below the orienting device (12).

Figure 2:
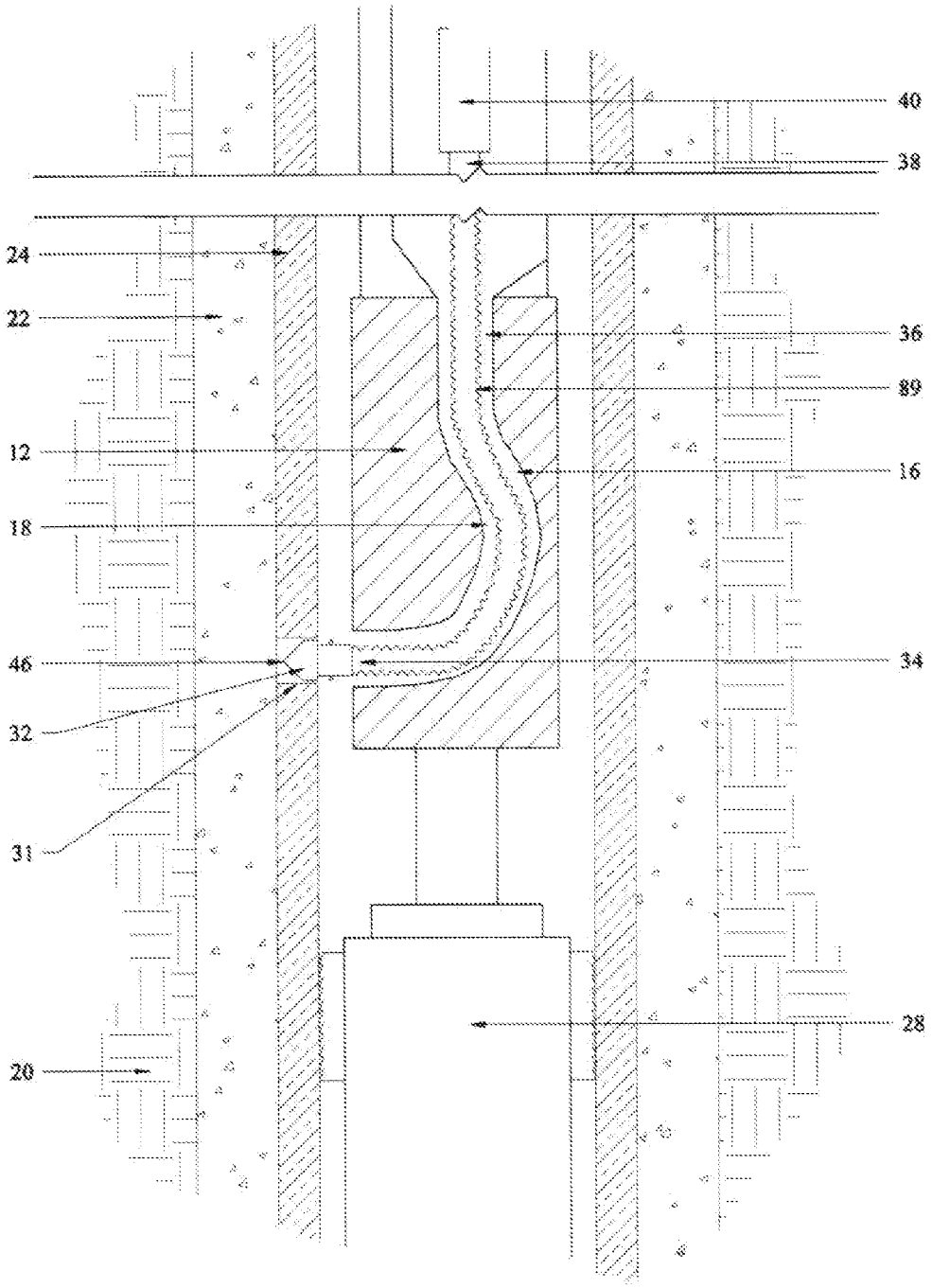
FIG. 2 illustrates a cross-sectional view of a cased wellbore containing a whipstock, wherein an embodiment of the present invention is deployed in the wellbore and is disposed to cut a lateral borehole thru a predefined hole in wellbore casing.

Looking now at FIG. 2, illustrated is a portion of the downhole tool assembly (18) that has been guided through the guide channel (16) defined by a whipstock (12) positioned on a packer (28). The cutting head (46) of the downhole tool assembly (18) is disposed in a pre-defined opening (31) in a portion of the casing (24) proximate the cement (22) and earthen formation (20). The first end portion (38) of the flexible tubular member (36) is operatively coupled to a rotational source (40) while the second end portion (34) of the flexible tubular member (36) is connected to a cutting head assembly (32). When activated, the motor (40) applies torque to the flexible tubular member (36), in this case a corrugated hose (89), which has been sized and configured to transfer the torque to the cutting head assembly (32), thereby enabling cutting of the cement (22) and earthen formation (20).

Figure 3:
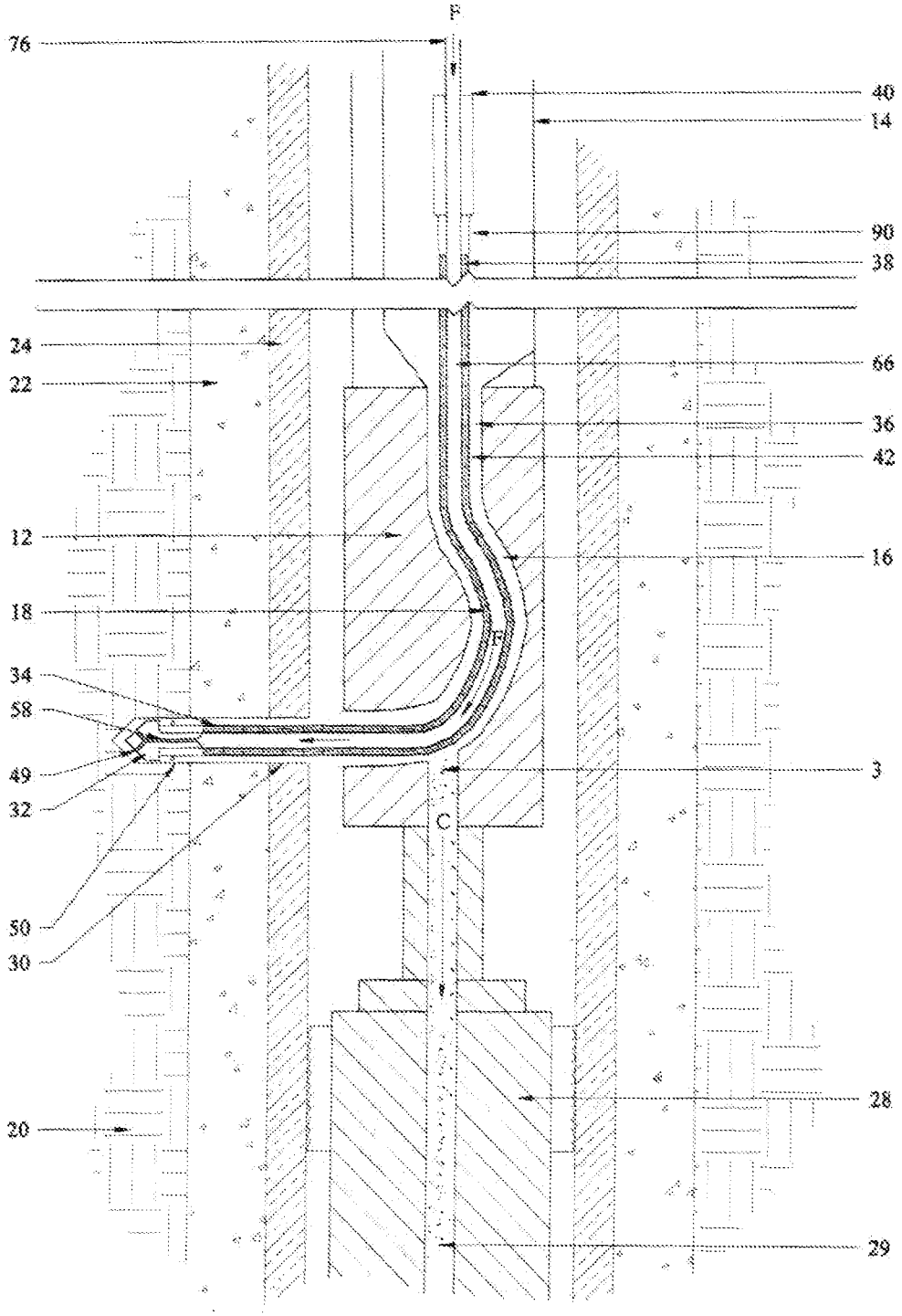
FIG. 3 illustrates a cross-sectional view of a cased wellbore containing a whipstock, wherein an embodiment of the present invention is deployed in the wellbore, guided through a guide channel in the whipstock, and has created a lateral borehole through the casing and cement and is proceeding into the earthen formation of interest.

FIG. 3 illustrates a downhole tool assembly (18) consistent with an embodiment of the present invention including a flexible tubular member (36) comprising an interlocking hose (42) wherein a first end portion of the flexible tubular member (38) is coupled to a motor (40) with a sub (90) shown disposed in upset tubing (14) and the second end portion of the flexible tubular member (34) is situated in a lateral borehole (50) and connected to a cutting head assembly (32). The orienting device (12) is shown with optional lower passageway (3) in communication with the guide channel (16) and allows for any cuttings (C) in the orienting device (12) to fall through a passageway (29) in the packer (28). As shown, the cutting head assembly (32) has been used to cut a hole (30) through the casing (24) and cement (22) and is beginning to form a lateral borehole (50) thru the earthen formation (20). Fluid (F) pumped from a fluid pumping source (not shown) down a conduit (76) engages the motor (40) and imparts rotation of the flexible tubular member (36) and attached cutting head assembly (32). The fluid (F), shown by arrows, exits the motor (40) passes thru an inner passageway (66) in the interlocking hose (42) and traverses thru a passageway (58) in the cutting head assembly (32) and exits at orifices (49).

Figure 4A:
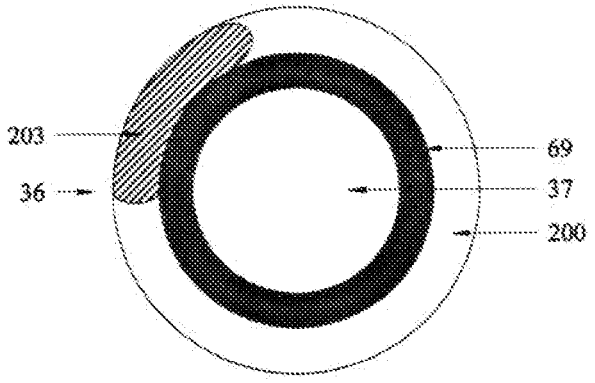
FIGS. 4A & 4B illustrate a flexible tubular member consistent with an embodiment of the present invention and comprising a spring circumscribed hose.
Figure 4B:
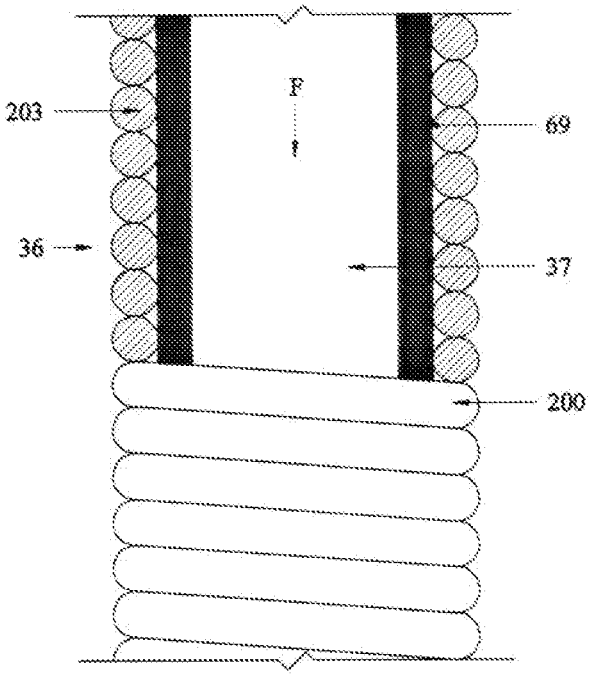

FIGS. 4A & 4B illustrate an embodiment of a partial flexible tubular member (36), in this case comprised of a spring (200) circumscribed hose (69). Evident is the inner passageway (37) of the hose (69) and the spring (200) used to transmit torque, as well as the spring cross-section (203). When under torque, the spring (200) tends to tighten about the hose (69). FIG. 4B illustrates a partial side and partial cross-sectional view of a flexible tubular member consistent with an embodiment of the present invention and comprising a spring (200) circumscribed hose (69).

Figure 5A:
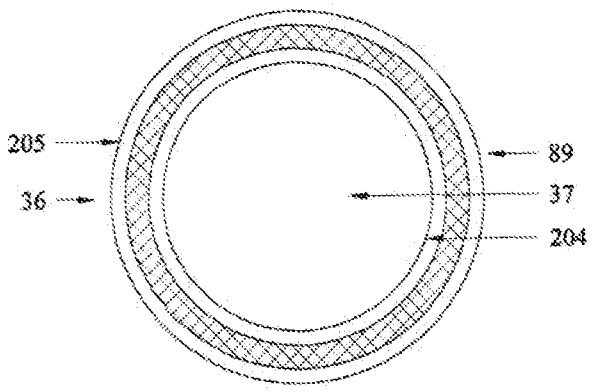
FIGS. 5A & 5B illustrate a flexible tubular member consistent with an embodiment of the present invention and comprising a corrugated hose.
Figure 5B:
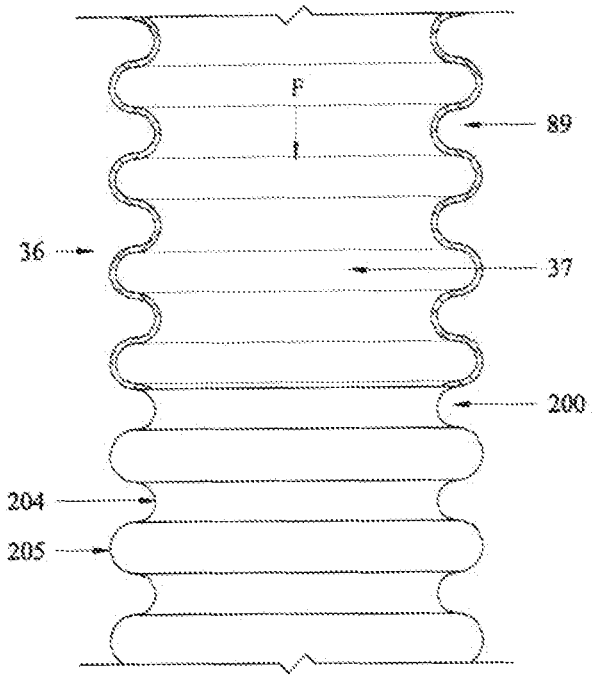

FIGS. 5A & 5B illustrate an embodiment of a partial flexible tubular member (36), in this case comprised of corrugated hose (89) used to transmit torque and inner passageway (37) for the transport of fluid (F). The minor diameters (204) and major diameters (205) of the corrugated hose (89) are evident. FIG. 5B illustrates a partial side and partial cross-sectional view of an embodiment comprising a corrugated hose (89).

Figure 6A:
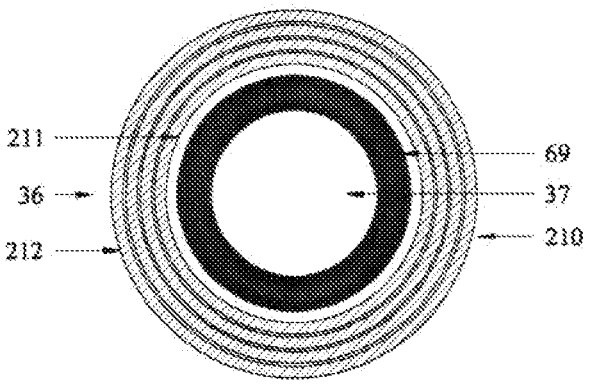
FIGS. 6A & 6B illustrate a flexible tubular member consistent with an embodiment of the present invention and comprising an interlocked hose or tubing.
Figure 6B:
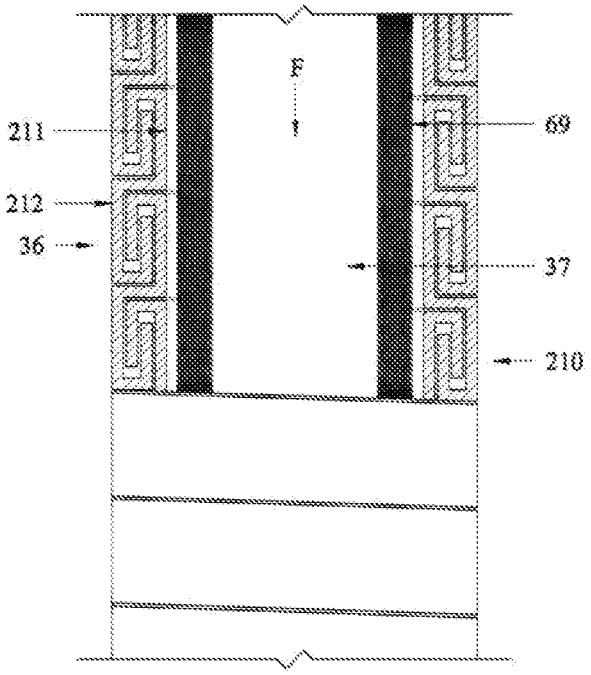

FIGS. 6A & 6B illustrate an embodiment of a partial flexible tubular member (36), in this case comprised of an interlocked tubing (210) circumscribing a hose (69). Evident is the inner passageway of the hose (37) for fluid (F) transport and a relatively inner section (211) and a relatively outer section (212) of the interlocking tubing (210) used to transmit torque. FIG. 6B illustrates a partial side and partial cross-sectional view of an embodiment comprising an interlocked hose (210). In this embodiment the interlocking tubing (210) can be considered the flexible tubular member and the hose (69) can be considered a secondary tubular member to provide fluid transport.

Figure 7A:
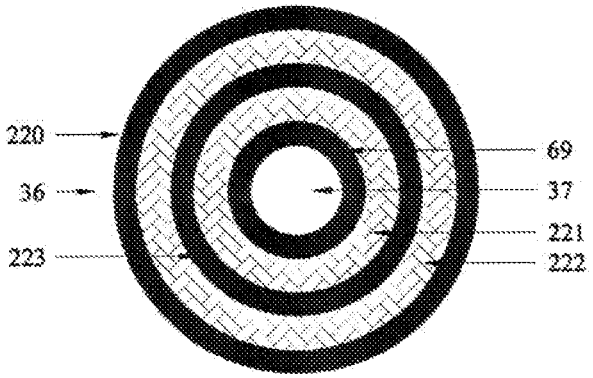
FIGS. 7A & 7B illustrate a flexible tubular member consistent with an embodiment of the present invention and comprising a stiff multi-braided hose.
Figure 7B:
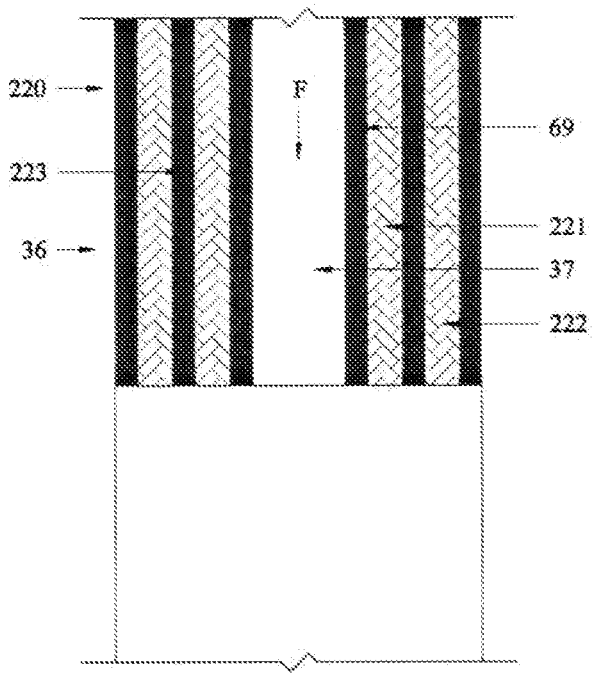

FIGS. 7A & 7B illustrate an embodiment of a partial flexible tubular member (36), in this case comprised of stiff multi-braded hose (220). Evident are the hose (69) with inner passageway (37) for the transport of fluid (F) and an elastomeric layer (223) situated between a heavy inner braided steel layer (221) and heavy outer braided steel layer (222) used to transmit torque. FIG. 7B illustrates a partial side and partial cross-sectional view of a comprising a stiff, multi-braided hose (220). In this embodiment the stiff multi-braided hose (220) can be considered the flexible tubular member and the hose (69) can be considered a secondary tubular member to provide fluid transport.

Figure 8A:
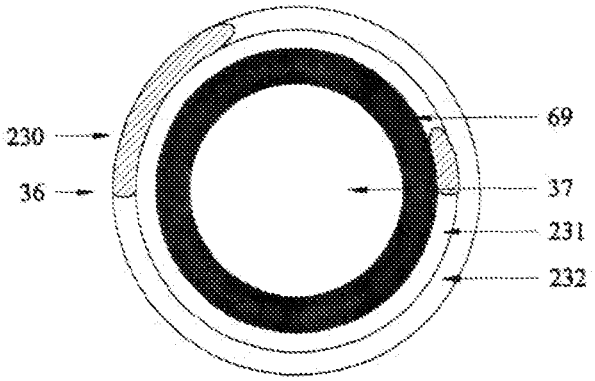
FIGS. 8A & 8B illustrate a flexible tubular member consistent with an embodiment of the present invention and comprising counter wound cables circumscribing a hose.
Figure 8B:
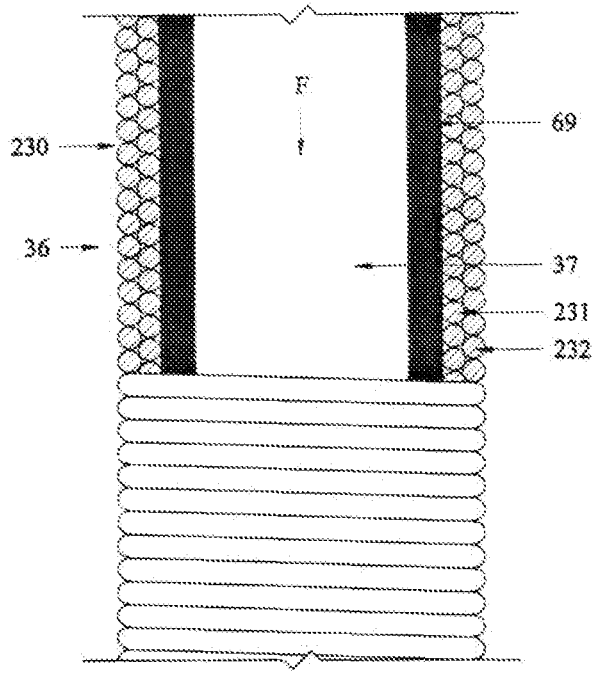

FIGS. 8A & 8B illustrate an embodiment of a partial flexible tubular member (36), in this case comprised of countered wound cables (230) circumscribing a hose (69) having an inner passageway (37) for the transport of fluid (F). Evident are the clockwise wound inner cable (231) and counter-clockwise wound outer cable (232) used to transmit torque. FIG. 8B illustrates a partial side and partial cross-sectional view of a comprising counter wound cables circumscribing an inner tubular hose. In this embodiment the wound cables (230) can be considered the flexible tubular member and the hose (69) can be considered a secondary tubular member to provide fluid transport.

Figure 9A:
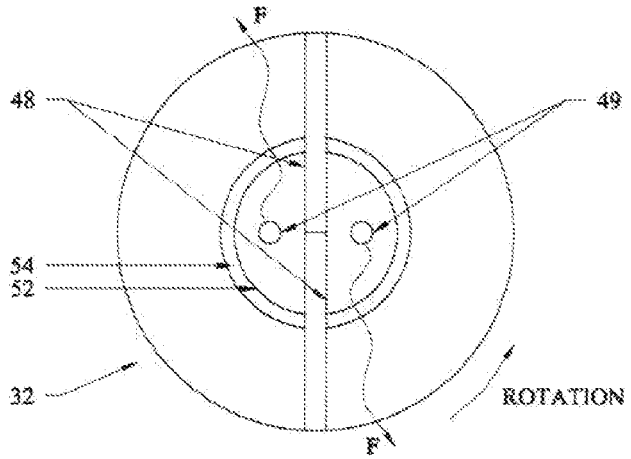
FIGS. 9A & 9B illustrate a portion of the downhole tool assembly, in this case a spring circumscribed hose and attached cutting head, consistent with an embodiment of the present invention.

FIG. 9A illustrates a frontal view of a cutting head assembly (32) consistent with an embodiment of the present invention. Evident on the cutting head assembly (32) are the cutting faces (48) and the nozzle head (52) with exit orifices (49) situated in a recess (54) open to the exterior of the cutting head assembly (32). In this depiction, rotation of the cutting head assembly (32) is counterclockwise, as shown by arrow. Fluid (F) exiting the exit orifices (49) can clean the cutting faces (48) and flow to the outside of the cutting head assembly (32), as shown by curved arrows.

Figure 9B:
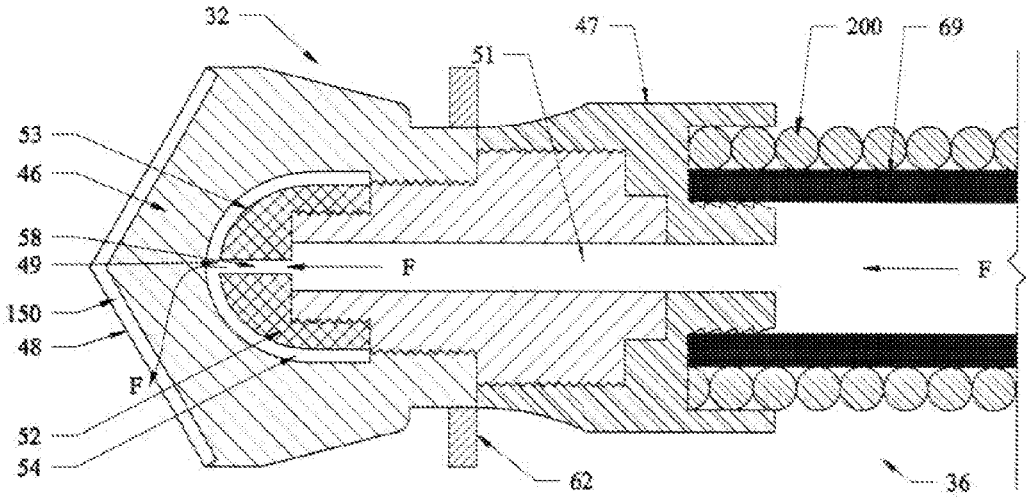

FIG. 9B illustrates a cutting head assembly (32) and a partial flexible tubular member (36), shown as a spring (200) circumscribed hose (69) consistent with an embodiment of the present invention. A connection fitting (47) ties the hose (69) to the cutting head (46) and the spring (200) used to transmit torque to the cutting head assembly (32). The connection fitting (47) has passageway (51) to enable fluid communication between the hose (69) and exit orifices (49) on the cutting head assembly (32). The cutting head assembly (32) includes a nozzle head (53) disposed within a recess open to the exterior (54) of the cutting head assembly (32). The cutting head assembly (32) has a centralizing mechanism (62), shown as pins. The nozzle head (53) is in fluid communication with the hose (69) and exit orifices (49) by interior nozzle passageway (58). Fluid (F) exits (as shown by arrows) the nozzle head (53) to keep the cutting faces (48) clean and cool. The cutting faces (48) are shown with optional carbide inserts (150) for improved mechanical cutting of the earthen formation (not shown). In this embodiment the spring (200) can be considered the flexible tubular member and the hose (69) can be considered a secondary tubular member to provide fluid transport.

Figure 10A:
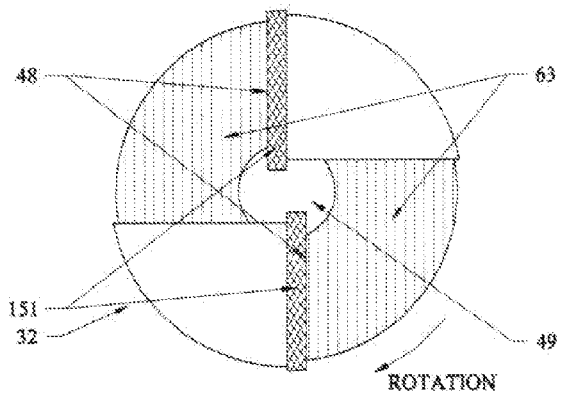
FIGS. 10A & 10B illustrate a portion of the downhole tool assembly, in this case a corrugated hose and attached cutting head, consistent with an embodiment of the present invention.

FIG. 10A illustrates a frontal view of a cutting head assembly (32) consistent with an embodiment of the present invention. Evident on the cutting head assembly (32) are diamond inserts (151) for improved cutting of the earthen formation (not shown) with cutting faces (48) an exit orifice (49). As shown by arrow indicating direction of rotation, behind the cutting faces (48) are back support areas (63) which provide structural support to the cutting faces (48) so as to resist breakage of the cutting faces (48) when cutting earthen formation (not shown).

Figure 10B:
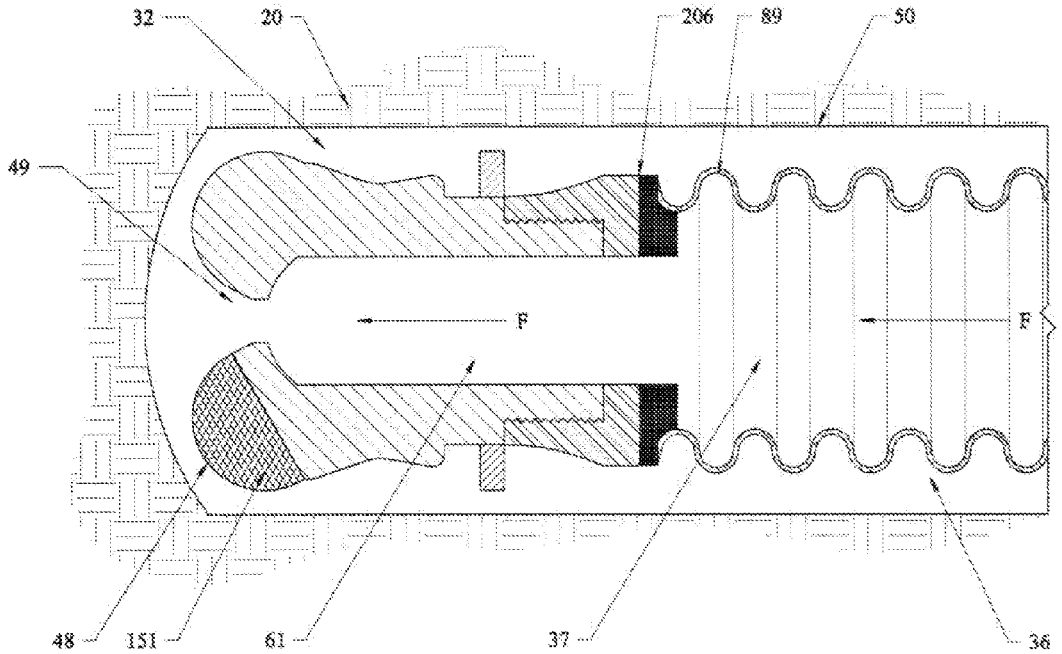

FIG. 10B shows a lateral borehole (50) in an earthen formation (20) containing an embodiment of the flexible tubular member (36) composed of a corrugated hose (89) used to transmit torque. The corrugated hose (89) has been affixed at connection point (206) to a cutting head assembly (32) having diamond inserts (151) on its cutting faces (48) (only visible on 1 side). Fluid (F) in the flexible tubular member inner passageway (37) traverses through the cutting head assembly (32) thru passageway (61) and exits the cutting head (32) at orifice (49) so as to keep the cutting faces (48) clean and cool.

Figure 11:
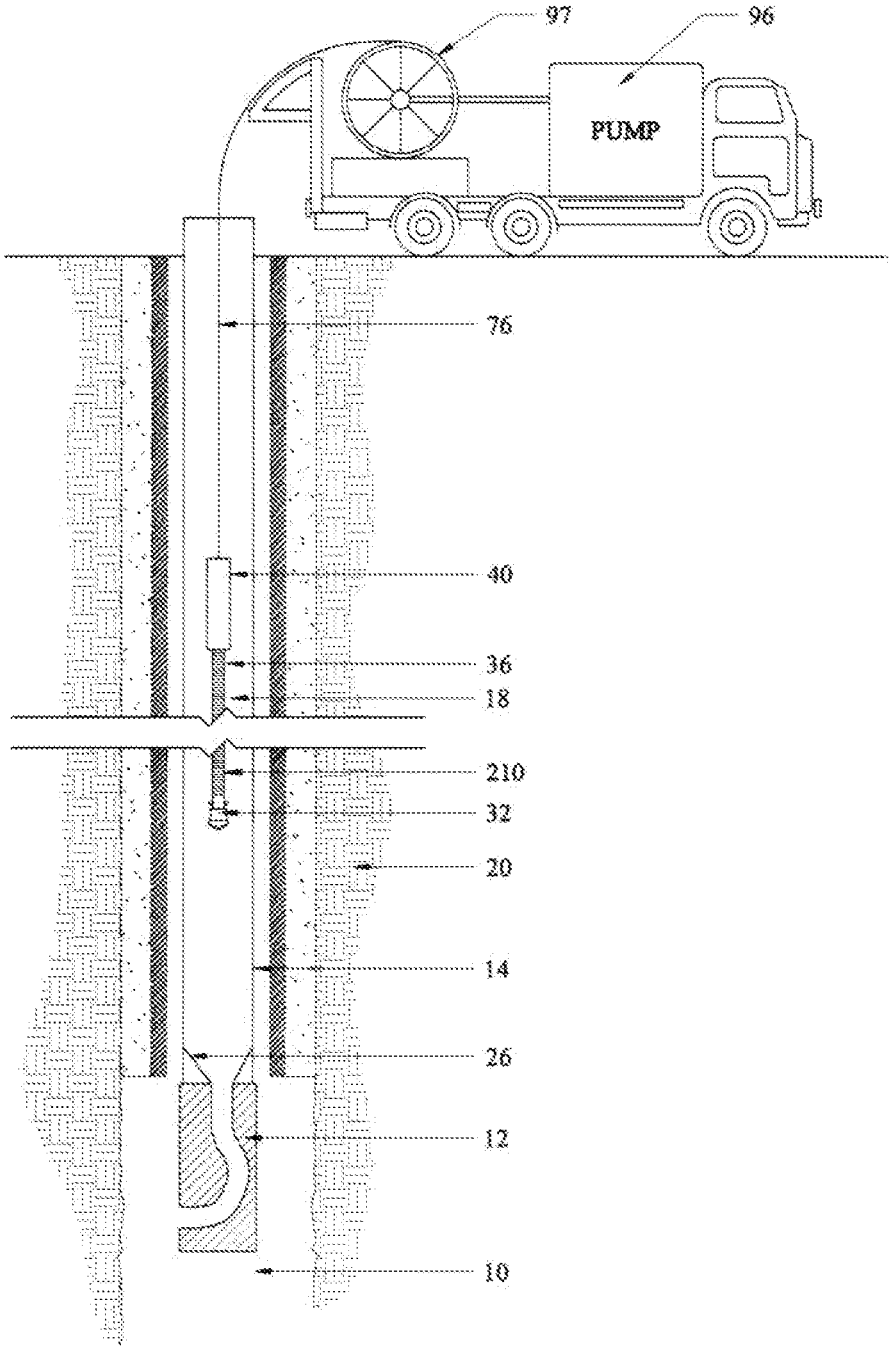
FIG. 11 illustrates the present invention situated downhole and operated by a coiled tubing unit, wherein the coiled tubing unit can pump fluid to drive a fluid motor used to rotate the flexible tubular member and attached cutting head consistent with an embodiment of the present invention.

FIG. 11 illustrates a cross sectional view of an embodiment of the present invention wherein a whipstock (12) with guiding plane (26) is positioned on upset tubing (14) in a wellbore (10) surrounded by earthen formation (20). The illustration shows the downhole tool assembly (18) being operated by a coiled tubing unit (97) and pumping equipment (96), used to pump fluid (not shown) down the conduit (76), in this case coiled tubing, to the motor (40) so as rotate the flexible tubular member (36), in this case interlocked tubing (210) and attached cutting head (32). In this embodiment the motor (40) can further include a means to vibrate at least a portion of the downhole assembly so as to mitigate the risk of the flexible tubular member (36) and/or the attached cutting head (32) from becoming stuck, such as during the drilling of a borehole. Optionally the means to vibrate at least a portion of the downhole assembly can be a feature separate and distinct from the motor (40), such as a set of hydraulic or mechanical jars (not shown) as part of the downhole assembly.

Figure 12:
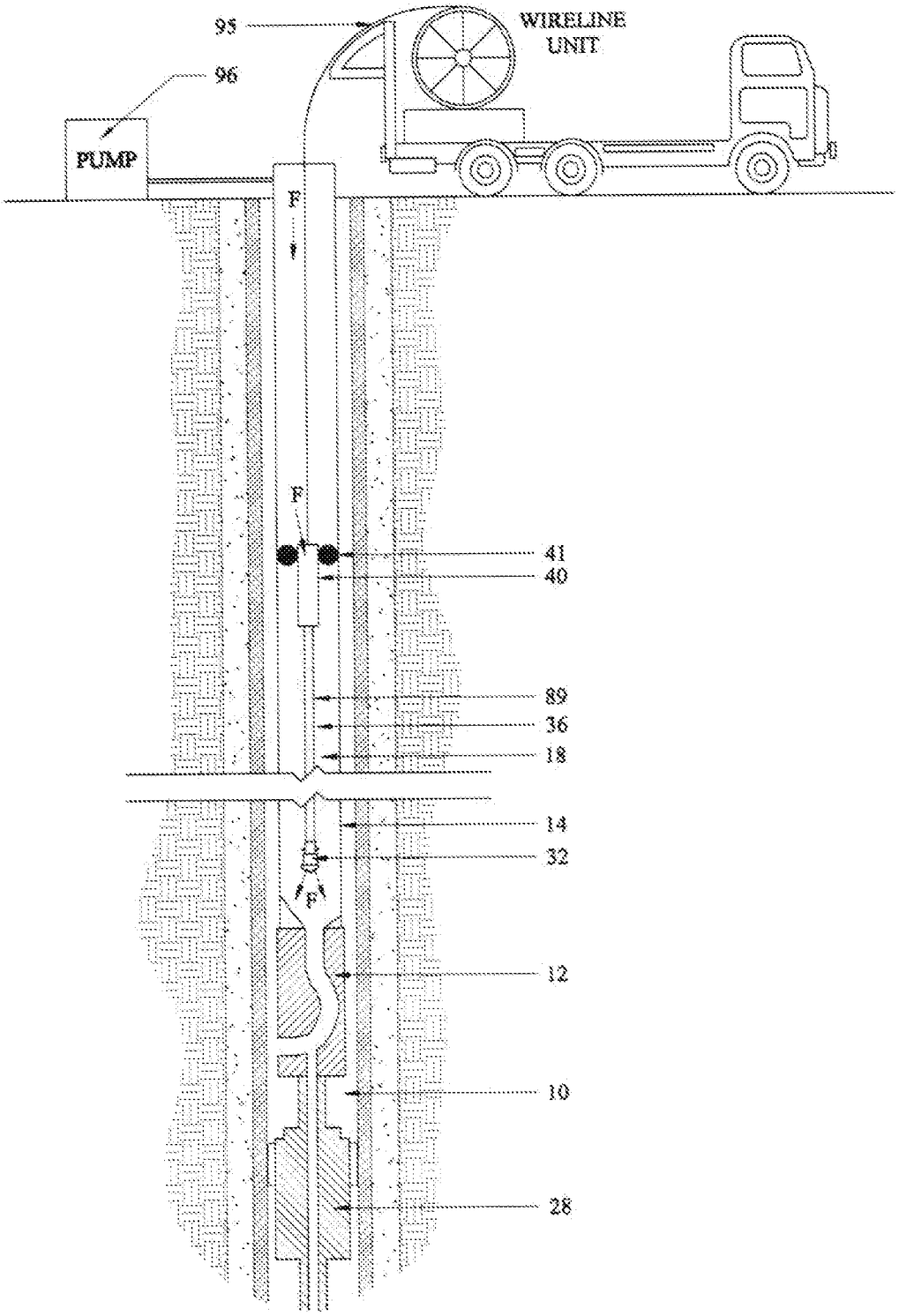
FIG. 12 illustrates the present invention situated downhole and operated by a wireline unit used in conjunction with pumping equipment and a downhole sealing mechanism used to direct the fluid into a motor thereby causing rotation of the flexible tubular member and attached cutting head consistent with an embodiment of the present invention.

FIG. 12 illustrates a wireline unit (95) and pumping equipment (96) positioned on a wellbore (10) in an embodiment of the present invention. In this case, the downhole tool assembly (18) is positioned above a whipstock (12) situated on a packer (28) and connected to upset tubing (14) which is also serves as a conduit to carry fluid (F), shown by arrows, from the pumping equipment (96) to the motor (40) that is attached to the flexible tubular member (36), in this case corrugated tubing (89). Seals (41) positioned between the fluid motor (40) and the upset tubing (14) direct (shown by arrows) fluid (F) into the motor (40) that in turn causes the attached flexible tubular member (36) and cutting head assembly (32) to rotate. As shown by arrows, the fluid (F) exits the cutting head assembly (32)

Figure 13:
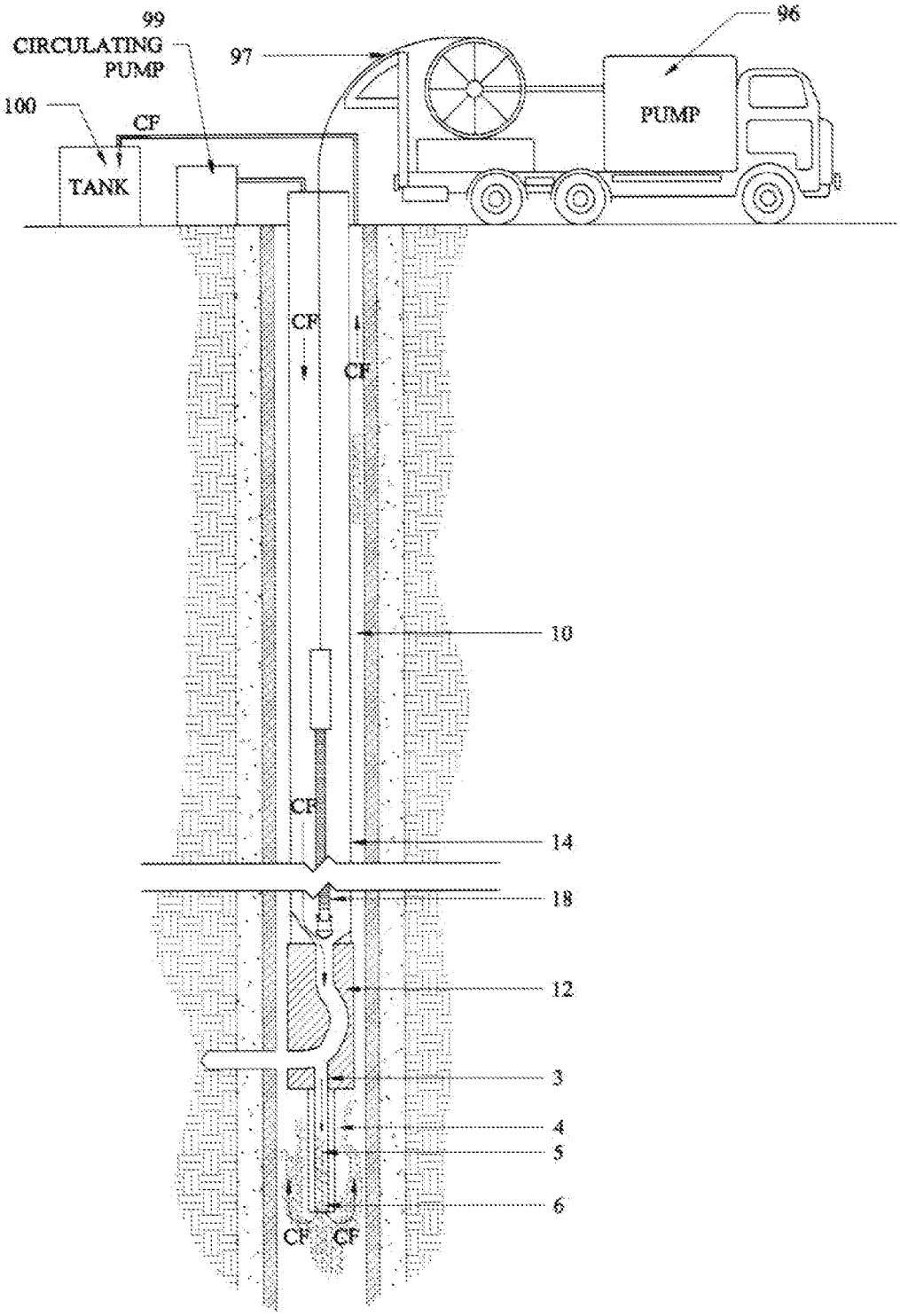
FIG. 13 illustrates the present invention situated downhole and operated by a coiled tubing unit used in conjunction with a circulating pump used to circulate cuttings out of the wellbore.

FIG. 13 illustrates a coiled tubing unit (97), circulating fluid pump (99) and cutting return tank (100) positioned on a wellbore (10) wherein the downhole tool assembly (18) is positioned in upset tubing (14) consistent with an embodiment of the present invention. Periodically, the circulating pump (99) may be used to pump circulating fluid (CF) down the upset tubing (14) and thru a lower passageway (3) below the whipstock (12) where it traverses a passageway (5) in a tubular member (4) and exits (6) so as to lift cuttings (C) out of the wellbore (10), as shown by arrows, where they may return to the cutting return tank (100).

As used herein, the term "hose" refers to elastomeric hose, single or multi-braided hose, sheathed hose, Kevlar® hose and comparable means of providing a means for fluid conduit.

As used herein, the terms "wire" or "cable" refers to wire and cable whether single or multi-stranded, wire rope and similar means for securing or providing tension between two ends.

As used herein, the term "fluid" refers to liquids, gases and/or any combination thereof.

Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Other and further embodiments, versions and examples of the invention may be devised without departing from the basic scope thereof and the scope thereof is determined by the claims that follow.

What is claimed is:

1. An apparatus for cutting laterally into an earthen formation from a wellbore comprising:

a flexible tubular member having at least one inner passageway;

the flexible tubular member being sized and configurable such that an attached cutting head assembly, the at least one inner passageway, and a fluid pumping source are in fluid communication;

wherein the cutting head assembly further comprises a centering member sized and configured to retain the cutting head assembly substantially longitudinal about the axis of a substantially horizontal wellbore created by the apparatus when engaged in cutting laterally into the earthen formation and wherein the cuttings from the earthen formation may travel past the centralizing mechanism toward the wellbore;

and wherein a first flexible tubular member end portion is sized and configured to be attachable to a rotation means and a second flexible tubular member end portion operatively coupled to the cutting head assembly such that torque applied to the first flexible tubular member end portion by the rotational source is translated to the cutting head assembly.

2. The apparatus of claim 1, wherein the cutting head assembly comprises at least one cutting surface sized and configured to mechanically cut into the earthen formation.

3. The apparatus of claim 1, wherein the cutting head assembly comprises a nozzle having at least one orifice for the ejection of fluid, gas or combination thereof positioned on or near the cutting head assembly and capable of being in fluid communication with the fluid pumping source.

4. The apparatus of claim 1, further comprising a secondary tubular member disposed within the at least one flexible tubular member inner passageway providing a substantially leak-proof fluid conduit between the pumping source and the cutting head assembly.

5. The apparatus of claim 1, wherein the flexible tubular member comprises corrugated hose.

6. The apparatus of claim 5, wherein the flexible tubular member comprises a flexible material selected from the group consisting of an elastomeric material, hose, braided-hose, flexible tubing, tubing, convoluted tubing, interlocking hose, semi-rigid tubing, or combinations thereof.

7. The apparatus of claim 3, capable of emitting fluid from the at least one orifice on the nozzle providing at least one of the following benefits: keeping the cutting head clean, keeping the cutting head cool, emitting fluid to better dispose the formation to being cut, emitting chemicals for treating the formation, or emitting fluid to provide a medium for carrying formation cuttings back toward the wellbore.

8. The apparatus of claim 1, wherein the flexible tubular member is primarily comprised of one continuous flexible tubular shaft, coupled to a cutting head on one end and a rotational means on the other.

9. The apparatus of claim 1, wherein the flexible tubular member is deployed within a wellbore by means selected from the group consisting of jointed tubing, wireline, slickline unit, coiled tubing, and combinations thereof.

10. The apparatus of claim 1, further comprising a rotational source selected from the group consisting of a fluid-driven motor, an electrical motor, or combinations thereof.

11. The apparatus of claim 1, further comprising a whipstock to guide the cutting head assembly and flexible tubular member toward the earthen formation.

12. The apparatus of claim 11, wherein the whipstock comprises a passageway through which formation cuttings can pass from the cutting head assembly to a location below the whipstock.

13. An apparatus for cutting laterally into an earthen formation from a wellbore comprising:

a flexible tubular member having at least one inner passageway;

the flexible tubular member being sized and configurable such that an attached cutting head assembly, the at least one inner passageway, and a fluid pumping source may be in fluid communication;

wherein a first flexible tubular member end portion is sized and configured to be attachable to a rotation means and a second flexible tubular member end portion operatively coupled to the cutting head assembly such that torque applied to the first flexible tubular member end portion by the rotational source may be translated to the cutting head assembly;

further comprising a sealing apparatus used in conjunction with a slickline unit allowing fluid communication with surface pumping equipment, said sealing apparatus providing a sealing mechanism between a fluid motor and a tubular extending to the surface thru which fluid can be pumped, said sealing mechanism diverting flow from the surface pumping equipment through said tubular and into the fluid motor causing rotation of the motor and attached flexible tubular member and ultimately cutting head assembly, said motor connected to a wireline whereby the flexible tubular member is lowered so as to create a lateral borehole in the earthen formation.

14. A method for cutting laterally into an earthen formation from a wellbore comprising:

guiding a downhole tool assembly comprising a flexible tubular member, with at least one inner passageway, through a channel defined by a guide assembly and positioning the downhole tool assembly within a wellbore so that the downhole tool assembly contacts a portion of the earthen formation to be laterally cut, wherein the downhole tool assembly is coupled to a conduit, such that the conduit and downhole tool assembly are in fluid communication;

pumping one or more fluids through the conduit and into the downhole tool assembly;

rotating a cutting head of the downhole assembly; and cutting a borehole into the earthen formation with the cutting head in a direction lateral to the wellbore;

further comprising a means to vibrate at least a portion of the downhole assembly so as to mitigate the cutting head assembly and/or flexible tubular member from becoming stuck in the borehole.

15. The method of claim 14, wherein the downhole tool assembly is operatively connected to a rotational source and the rotational source is coupled to a conduit, such that the conduit, rotational source, and downhole tool assembly are in fluid communication;

activating the rotational source, wherein a torque is applied to the flexible tubular member; and translating the torque to a cutting head of the downhole tool assembly, wherein the torque causes the cutting head to rotate.

16. The method of claim 14, wherein the rotational source is activated by the fluid flow through the conduit into the rotational source.

17. The method of claim 14, wherein the downhole tool assembly further comprises at least one nozzle defining one or more openings in the cutting head in fluid communication with at least a portion of the tubular member fluid passageway, wherein the method further comprises pumping one or more fluids through the tubular member fluid passageway; and emitting the pumped fluid from the nozzle openings, whereby the fluid may contact the cutting head.

18. The method of claim 17, wherein the nozzle openings comprise one or more orifices selected from the group consisting of: a nozzle orifice at the center of the cutting head, a nozzle orifice(s) that are situated about the radius of the axis of rotation of the nozzle head, a rotating nozzle and combinations thereof.

19. The method of claim 14, wherein fluid is pumped through a fluid motor so as to rotate the flexible tubular member and the cutting head of to cut earthen formation.

20. The method of claim 14, further comprising forming a lateral borehole through a pre-existing hole created thru the casing; said hole created by one or more of the following methods: milling out the section of casing, abrasively cutting the casing, punching through the casing, cutting a hole in the casing, or using chemical to erode the wellbore casing.

21. The method of claim 14, further comprising forming a hole through a wellbore casing and further lowering the downhole tool assembly under rotation so as to cut through any adjacent cement and into the earthen formation.

22. The method of claim 14, further comprising pumping fluid to a location beneath the downhole tool assembly and at a sufficient velocity so as either suspend formation cuttings within the wellbore or to lift the cuttings to the surface; said procedure being done initially, periodically or continuously during the creation of the lateral borehole.

23. The method of claim 14, wherein the wellbore is an open hole wellbore and a borehole is formed into the earthen formation in a direction lateral to the open hole wellbore.

* * * * *